US005667097A

United States Patent [19]

Joyce

[11] Patent Number: 5,667,097

[45] Date of Patent: Sep. 16, 1997

[54] MULTIPLE PILL DISPENSING UNIT

[76] Inventor: Charles E. Joyce, 22586 Dunkenfield Cir., Lake Forest, Calif. 92630

[21] Appl. No.: 426,282

[22] Filed: Apr. 21, 1995

Related U.S. Application Data

[63] Continuation-in-part of Ser. No. 331,053, Oct. 28, 1994, abandoned.

[51] Int. Cl.[6] ..... B65H 3/44

[52] U.S. Cl. ..... 221/93; 221/264

[58] Field of Search ..... 221/93, 264, 155, 221/268, 263, 133

[56] References Cited

U.S. PATENT DOCUMENTS

| | | | |
|---|---|---|---|
| 2,683,554 | 7/1954 | Mulhauser, Jr. | 221/265 |
| 4,101,284 | 7/1978 | Difiglio et al. | 221/264 |
| 5,004,122 | 4/1991 | Polynter | 221/155 |

FOREIGN PATENT DOCUMENTS

| | | | |
|---|---|---|---|
| 2692769 | 12/1993 | France | 221/264 |

*Primary Examiner*—Kenneth Noland

[57] ABSTRACT

An apparatus for housing multiple shapes and sizes of pills and simultaneously dispensing a single pill of each type, the apparatus comprising a vertically oriented support structure with an upper, middle and lower housing portions, each portion including a plurality of identically sized and spaced conduits. The upper conduits house a plurality of pills, while each of the middle conduits are designed to hold a single pill. The middle housing portion is capable of horizontal motion, and is normally positioned in an initial holding position in which the upper and middle conduits are aligned, and the middle and lower conduits are off-set. When the middle portion is moved into a second, release position, the middle conduits misalign with the upper conduits and align with the lower conduits, thereby allowing the single pill contained within each of the middle conduits to drop through the lower conduits and into the user's hand or, alternately, into a hollow collection area for retrieving the dispensed pills.

11 Claims, 6 Drawing Sheets

MULTIPLE PILL DISPENSING UNIT

This application is a continuation in part of a previously filed similar patent aplication Ser. No. 08/331,053, filed on Oct. 28, 1994 now abandoned.

BACKGROUND OF THE INVENTION

1. Field of the Invention

This invention relates generally to dispensing devices and more particularly to a device designed to dispense multiple pills in a single operation.

2. Description of Related Art

Invention and use of medicine dispensing devices are known to the public, as there are numerous such devices currently commercially available. These devices are designed to meet a wide variety of different medical needs, ranging from simple storage units for a single pill per day to complex housing units for dispensing several medications at various times throughout the day.

For example, U.S. Pat. No. 4,807,757 issued to Lisa Rappaport et al. details a vertical storage arrangement with a dispensing door that moves vertically to release a pill and indicate which pills have been taken. This device is effective for single daily doses, such as birth control pills, but is limited in that it is designed to hold only one type of medication and dispense it one pill at a time. As such, it is incapable of meeting the needs of people taking multiple medications.

A number of patents have been issued to meet the needs of people with more complex medication schedules. For example, U.S. Pat. No. 4,126,247, issued to Anthony Majka teaches a gravity feed of pill combinations stored in compartments corresponding to the days in the month, whereby on a given day a trap door is sprung to drop the appropriate medications to a pickup slot. U.S. Pat. No. 5,133,478, issued to Steven Gordon (1992) discloses a device with a vertical matrix of storage spaces for groups of pills to be taken on a given day and at a given time. A timer and clock display may also be integrated into the device so as to provide an audio display and illuminate the particular push button corresponding to the medication to be taken at a particular time. Thomas Moulding, Jr. et al. discloses a device that effectively caters to the needs of those taking multiple medications at varying times in U.S. Pat. No. 5,219,093. This patent teaches a vertically disposed dispensing device for selectively orienting a pill or capsule for dispensing into a specific element such as a slot in a conveyor. The dispenser may include a computer for controlling and/or recording the time of dispensing and the quantity of medication dispensed.

These devices are effective in catering to the needs of those taking large quantities of medication with dosages that vary from day to day or hour to hour. However, for people with less complex medication schedules, these devices require unnecessary time and effort to presort the pills and load them properly into the appropriate compartments.

To comply with all medication schedules, Brad Ridgley introduced U.S. Pat. No. 4,616,752. Ridgley's device teaches a bulk dispenser that individually houses numerous different medications. The dispenser has a gravity feed to a set of doors through which pills are removed. When a door is opened, a large number of pills are readily available, and the individual simply takes out the number of each pill desired. However, this requires that the user open each individual door and count out the desired number of pills. While such a device is useful when large doses of each medicine are required, or different mounts of each pill are needed, it is rather inconvenient for those with simpler medication schedules.

As such, none of the prior art devices are able to simply and efficiently supply a single dose of multiple medications. Thus, there is a need for a convenient dispensing device that houses several different medications and effectively, simultaneously dispenses a single dose of each medication in a single operation. The present invention fulfills this need and provides further related advantages as described in the following summary.

SUMMARY OF THE INVENTION

The present invention is a dispensing device designed to individually contain numerous different kinds and sizes of pills and simultaneously dispense one pill of each type with a simple hand movement. It is thus a principle object of the invention to administer medications with greater precision by automatically dispensing a single dose of each type of medication, thereby preventing the user from forgetting which pills have already been taken. The device also eliminates the repeated, tedious, opening of several medicine bottles each time the medicine is to be taken.

The device has a rectangular or cylindrical, vertically oriented shape and includes a support structure with an upper, middle and lower housing portions. Each of the portions has a series of through running vertical conduits. These conduits are of various shapes and sizes conforming to standard pill sizes so that each conduit can contain a different sized pill. It is therefore an object of the invention to improve over the prior art by easily allotting a dally dose of multiple medications without requiring a complicated sorting process of each day's allotment.

It is a further object of the invention to provide a large storage capacity so that the device does not need to be frequently refilled. To accomplish this, the vertical conduits of the upper housing are manufactured to be deep enough to hold at least ten of each pill. For convenience, the device is preferably made of transparent plastic so that the pill supply in the upper housing can be easily monitored and refilled before it is completely exhausted.

It is another object of the present invention to prevent any of the pills from being lost or damaged once a dosage has been released. This is accomplished by causing the released pills to drop immediately into the user's hand, or, alternately, into a storage area provided beneath the support structure. In either case, the dispensed pills are easily accessed and immediately available to the user as an object of the invention.

In a rectangular arrangement of the housing, the middle housing portion preferably consists of a moveable tray sandwiched between the upper and lower housing portions. Normally, the tray remains in an initial, holding position so that the conduits in the tray line up perfectly with those of the upper housing, gravity thus forcing a single pill from each upper conduit to move downward into the corresponding middle conduit. However, in this position the conduits on the lower housing are offset from those of the tray, thus keeping each pill lodged in the appropriate middle conduit. When the tray is moved into a release position, the middle conduits align with the corresponding lower conduits, thus allowing the pills to drop through the aligned conduits. In this position, the conduits in the tray no longer align with the conduits in the upper housing, thereby preventing more than one pill in each conduit from being released.

It is another object of the invention to provide a simple means by which to access the enclosed pills. When the support structure has a rectangular configuration, the tray is limited to linear horizontal motion only. Thus, an outwardly extending lever is provided by which to push the tray from the initial forward position into the release position. On the other hand, when the support structure has a cylindrical configuration the tray is limited to rotational horizontal movement. Thus, to release the pills, the support structure is simply grasped and rotated approximately 16° into the release position. In either embodiment, when the tray is moved into the release position it contacts and compresses a spring or similar bias means, so that when the external pressure is released, the spring returns to an extended position, thus automatically moving the tray back to the initial holding position.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
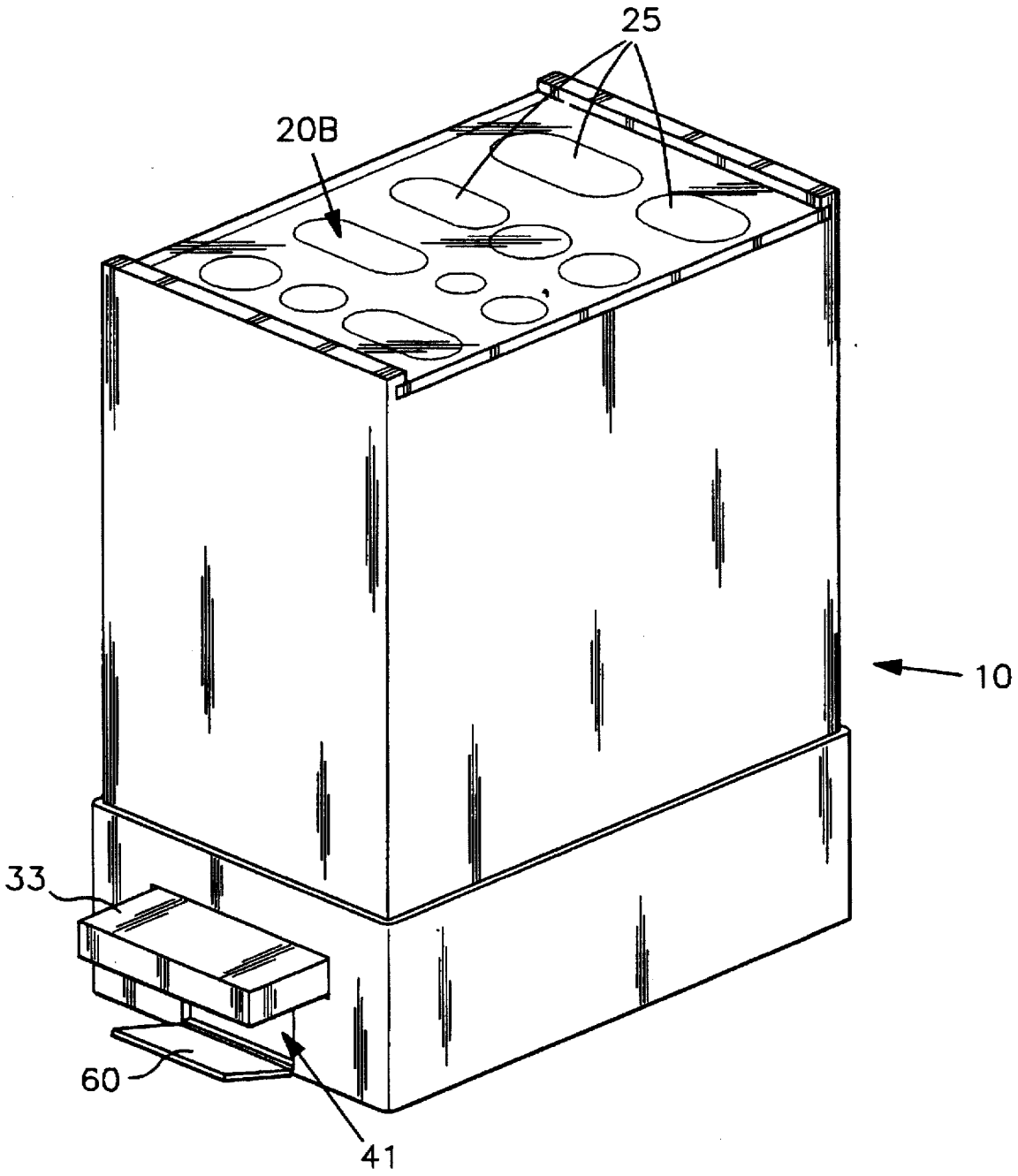
FIG. 1 is a perspective view of the invention, particularly showing a rectangular box-like support structure and its various sized pill conduits.

FIG. 1 shows a pill dispensing apparatus that is designed to house and simultaneously dispense a variety of various shaped pills 1. Preferably, the apparatus is constructed from a moldable structural plastic having at least partial transparency, so that the pill inventory can be visually monitored.

Figure 5:
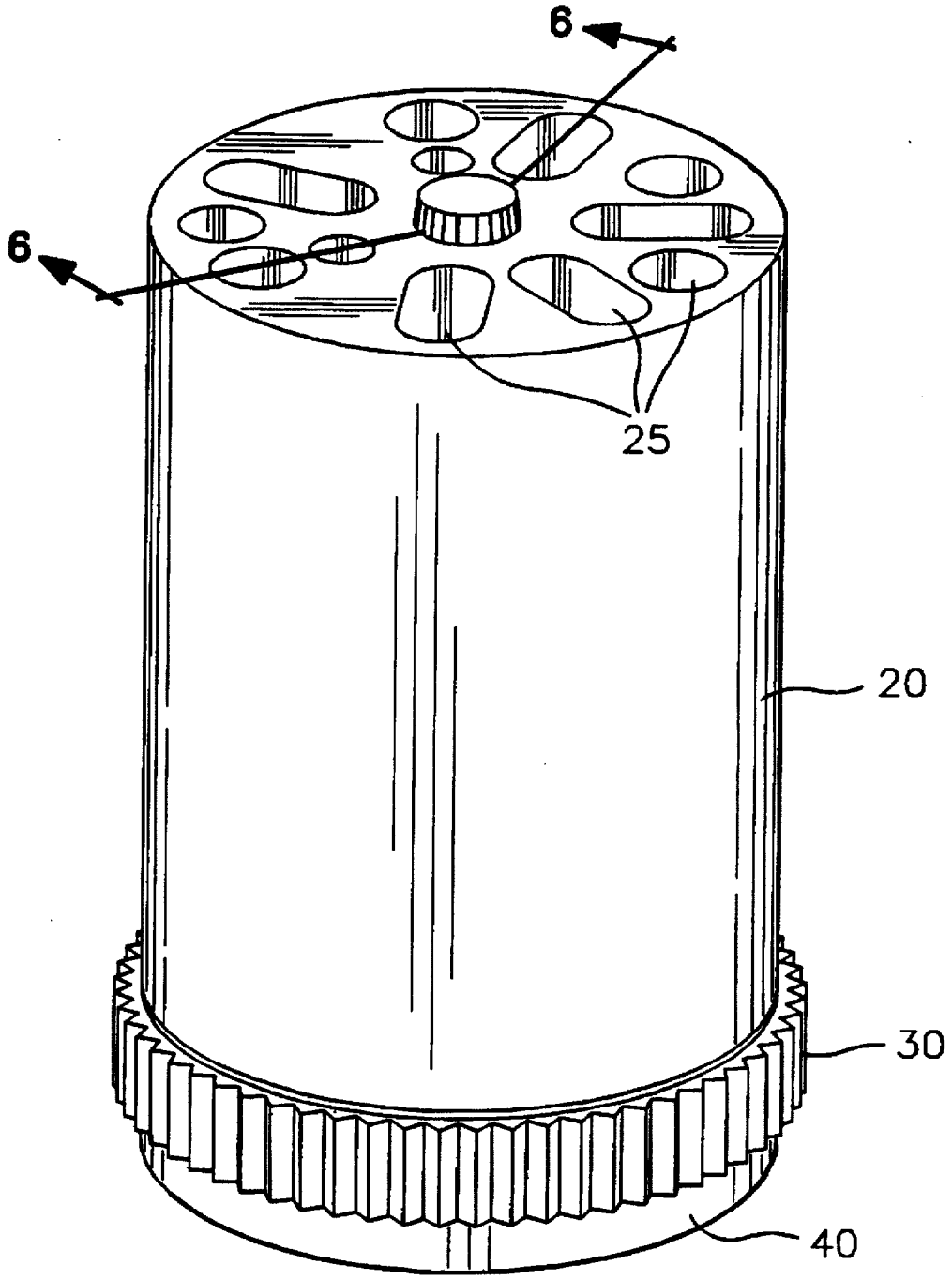
FIG. 5 is a perspective view of the invention, particularly showing a cylindrical support structure embodiment of the present invention and an arrangement of its various pill conduits.

The apparatus has a vertically oriented support structure 10 that is constructed with either a box-like rectangular or cylindrical shape as shown in FIG. 1 or FIG. 5 respectively. The support structure 10 is dominated by an upper 20, middle 30 and lower 40 housing portions. Each of the housing portions 20, 30 and 40 include a plurality of vertically disposed conduits 25, 35 and 45 respectively. The conduits of each housing portion 20, 30 and 40 are identically sized, shaped and aligned in a preferred positional arrangement. Each individual conduit has a uniform horizontal cross-sectional shape 20B approximating the cross-sectional shape of one of the pills 1. Preferably, the cross-sectional shape 20B of each conduit varies from that of the other conduits, so that each conduit houses a different sized pill 1. However, all of the conduits may also be constructed with a uniform shape or of any other combination of shapes to accommodate individual medical needs. Each of the conduits 25, 35 and 45 has a closed interior sidewall 20A closely conforming to the shape of vertically stacked pills.

The interior conduit sidewalls 20A of the upper housing conduits 25 have a height great enough so that each of the upper conduits 25 can accommodate a plurality of complementary sized pills stacked vertically one above the next. Preferably, the vertical height of the interior conduit sidewalls 20A allows at least ten pills to be vertically stacked within, although the interior conduit sidewalls 20A may be made to any desired fixed height to suit individual medical needs. The conduits 35 of the middle housing portion 30, on the other hand, have a vertical height appropriate for accommodating only a single pill in each. Since individual pills are of various heights, it is necessary therefore to provide for at least several heights in the middle housing portion 30.

Figure 2:
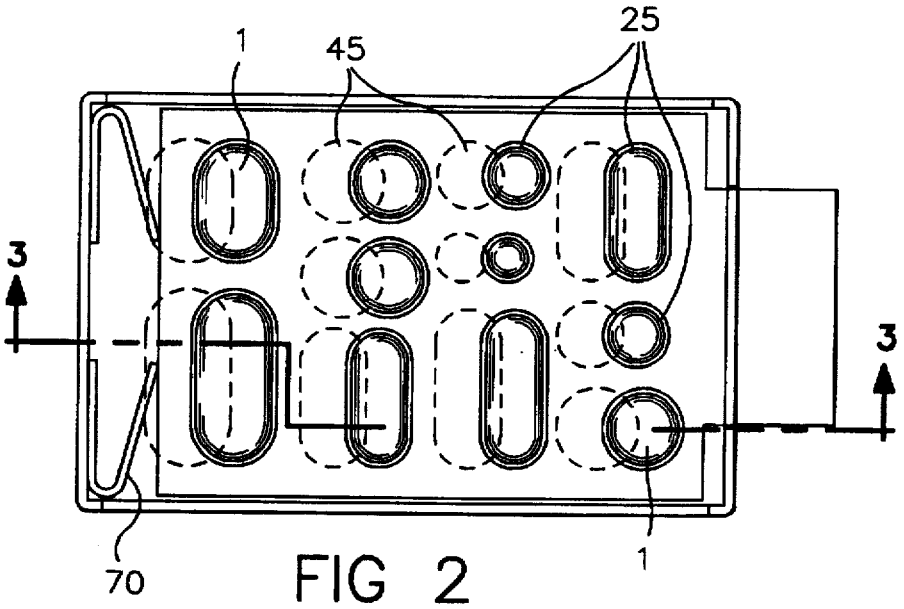
FIG. 2 is a top plan view of the invention of FIG. 1, particularly showing the arrangement of the apertures.
Figure 3:
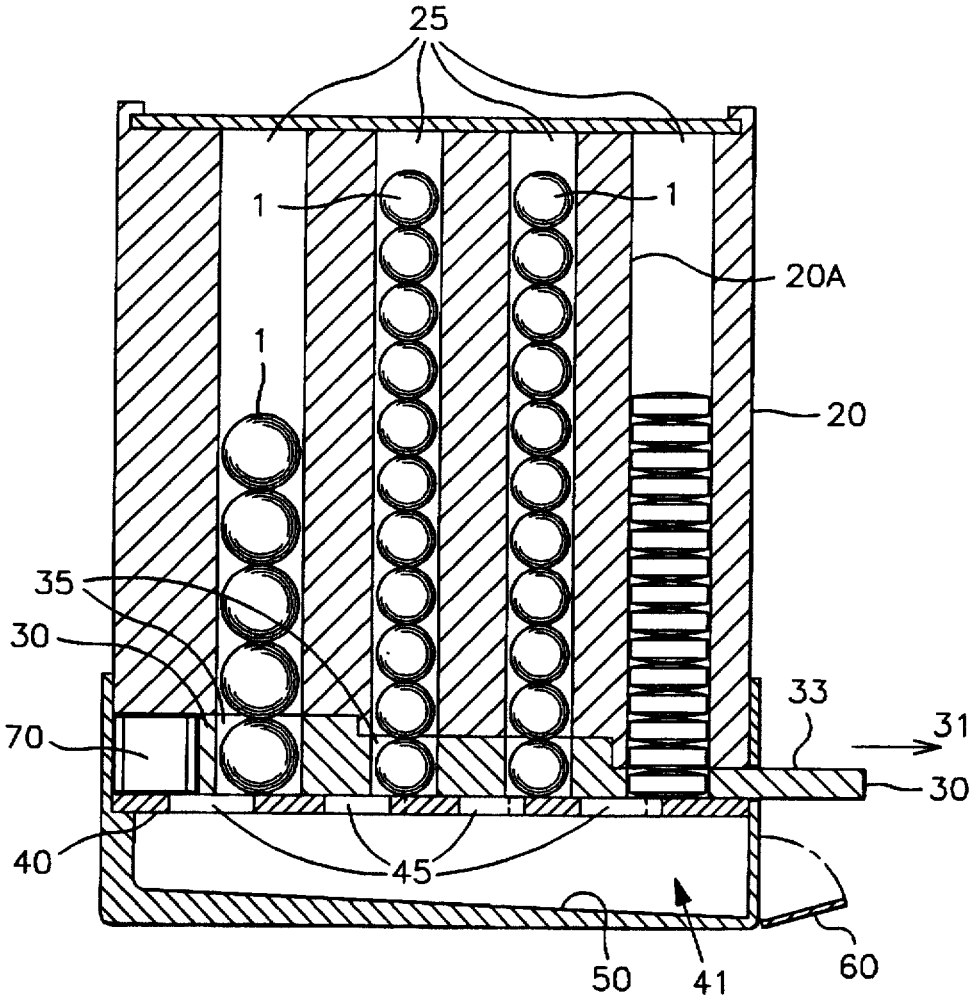
FIG. 3 is a cross-sectional view of the invention of FIG. 1 taken along line 3—3, particularly showing the placement of the pills within the conduits when the middle housing portion or tray is in the normal, holding position.
Figure 4:
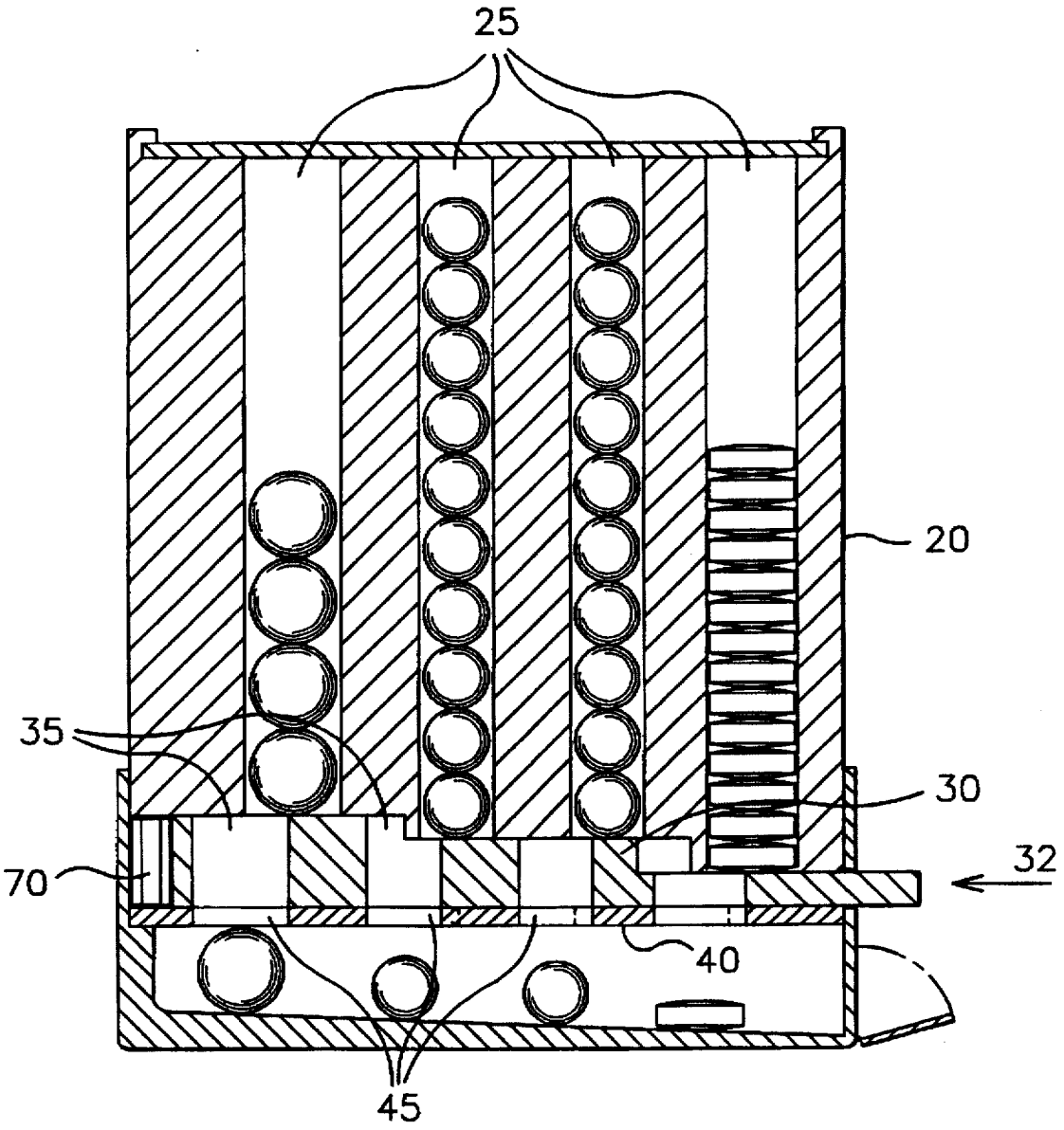
FIG. 4 is a cross-sectional view of the invention of FIG. 1 taken along line 3—3, particularly showing the placement of the pills within the conduits when the tray is moved to the release position.

Both the upper 20 and lower 40 housing portions are mutually joined in fixed juxtaposition so that the conduits 45 in the lower housing portion 40 are misaligned with those of the upper housing portion 20. The middle housing portion 30 in the box-like embodiment, preferably consists of a movable sliding tray sandwiched between the upper 20 and the lower 40 housing portions and constrained to horizontal movement between an initial holding position 31 and a second release position 32. The tray is normally positioned in the initial holding position 31 in which the conduits 35 of the middle housing portion 30 are aligned with those of the upper housing portion 20, thus allowing exactly one pill from each of the upper conduits 25 to move downwardly into the middle conduits 35. As seen in FIGS. 2 and 3, when the tray is in the initial position 31, the middle and lower conduits are off-set from one another. Thus, as long as the tray remains in the initial holding position 31, the pills cannot be released. However, when the tray is moved to the release position 32, as illustrated in FIG. 4, the middle 35 and lower 45 conduits are aligned with one another so that the single pill contained within each of the middle conduits 35 falls through the lower conduits 45 and into a user's hand, or, alternately, into a provided storage area. As illustrated, when the tray is moved to the second position 32, the middle 35 and upper 25 conduits are offset, thus preventing any further pills other then the one positioned in each of the conduits in the middle housing portion from dropping downward, and from being released.

When the support structure 10 is constructed with the rectangular box-like shape, the middle housing portion 30 is a moving tray constrained to linear horizontal motion between the initial holding position 31 and the release position 32. As seen in FIG. 1, in this embodiment the tray preferably includes a lever 33 that extends forward from the apparatus. The lever 33 is positioned and formed so that pressing it toward the support structure 10 pushes the tray from the holding position 31 into the release position 32, thus allowing one pill to fall through each of the lower conduits 45.

Figure 9:
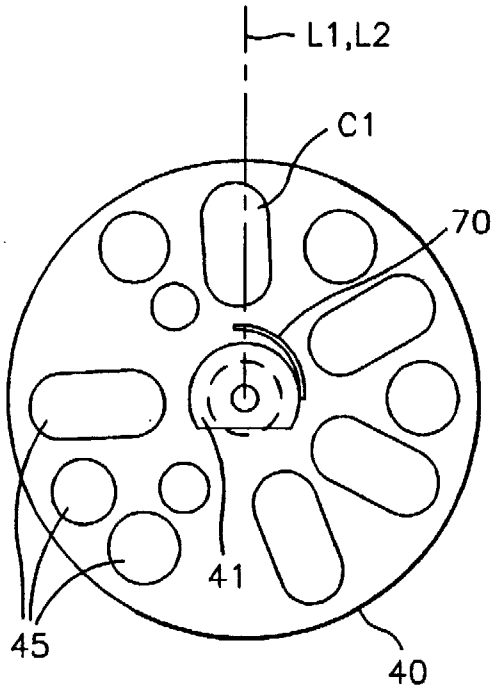
FIG. 9 is a plan view of the lower housing portion particularly showing the fixed placement of the conduits as arranged in correspondence with the upper and middle housing portion but positioned in a misaligned clock position with respect to the upper and the middle housing portions.
Figure 8:
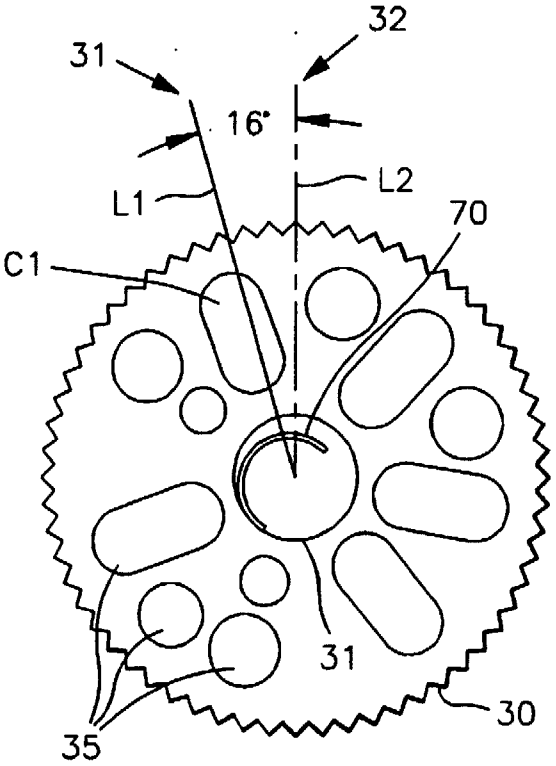
FIG. 8 is a plan view of the middle housing portion particularly showing the placement of the conduits when the middle housing portion is at the normal rest position.
Figure 7:
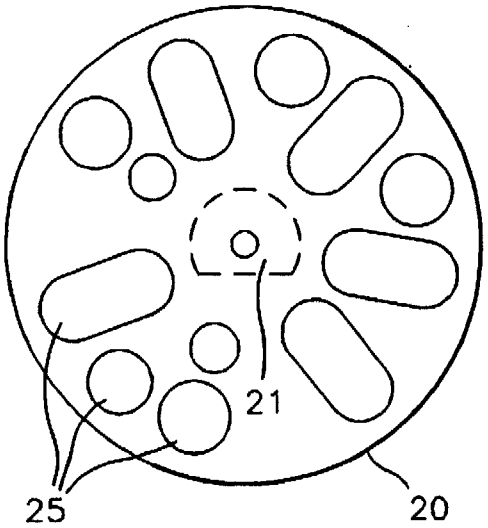
FIG. 7 is a plan view of the upper housing portion particularly showing the arrangement of the conduits.

Alternately, when the support structure 10 is formed as a cylindrical shape, as illustrated in FIG. 5, the middle housing portion 30, is constrained to rotational horizontal movement between the holding 31 and release 32 positions as best shown in FIG. 8. The preferred attachment of lower housing portion 40 to upper housing portion 20 is via a stud 41 extending upwardly into a cavity 21 in upper housing portion 20. Both the stud 41 and the cavity 21 are D shaped so that relative rotational motion between these two portions is not possible. A hole 31 in middle housing portion 30 is slightly larger then stud 41 so that middle housing portion easily rotates about stud 41. With the three housing portions 20, 30 and 40 assembled, a thin coil spring is preferably bonded between the stud 41 and the hole 31 in the middle housing portion, so as to provide bias means 70. FIG. 8 shows radial lines L1 and L2 indicating that the specific conduit C1 is positioned preferably 16 rotational degrees from the vertical line L2. In FIG. 9 is shown that C1 is aligned with L2. Thus such a clockwise rotation of the middle housing portion 30 relative to the lower housing portion 40 provides for alignment of all of the conduits 35 and 45 in the two portions. In this embodiment, the middle housing portion is configured so that it is simply rotated, preferably approximately 16°, from the initial holding position 31 into the release position 32 in order to release the a pills 1 through each of the lower conduits 45.

Figure 6:
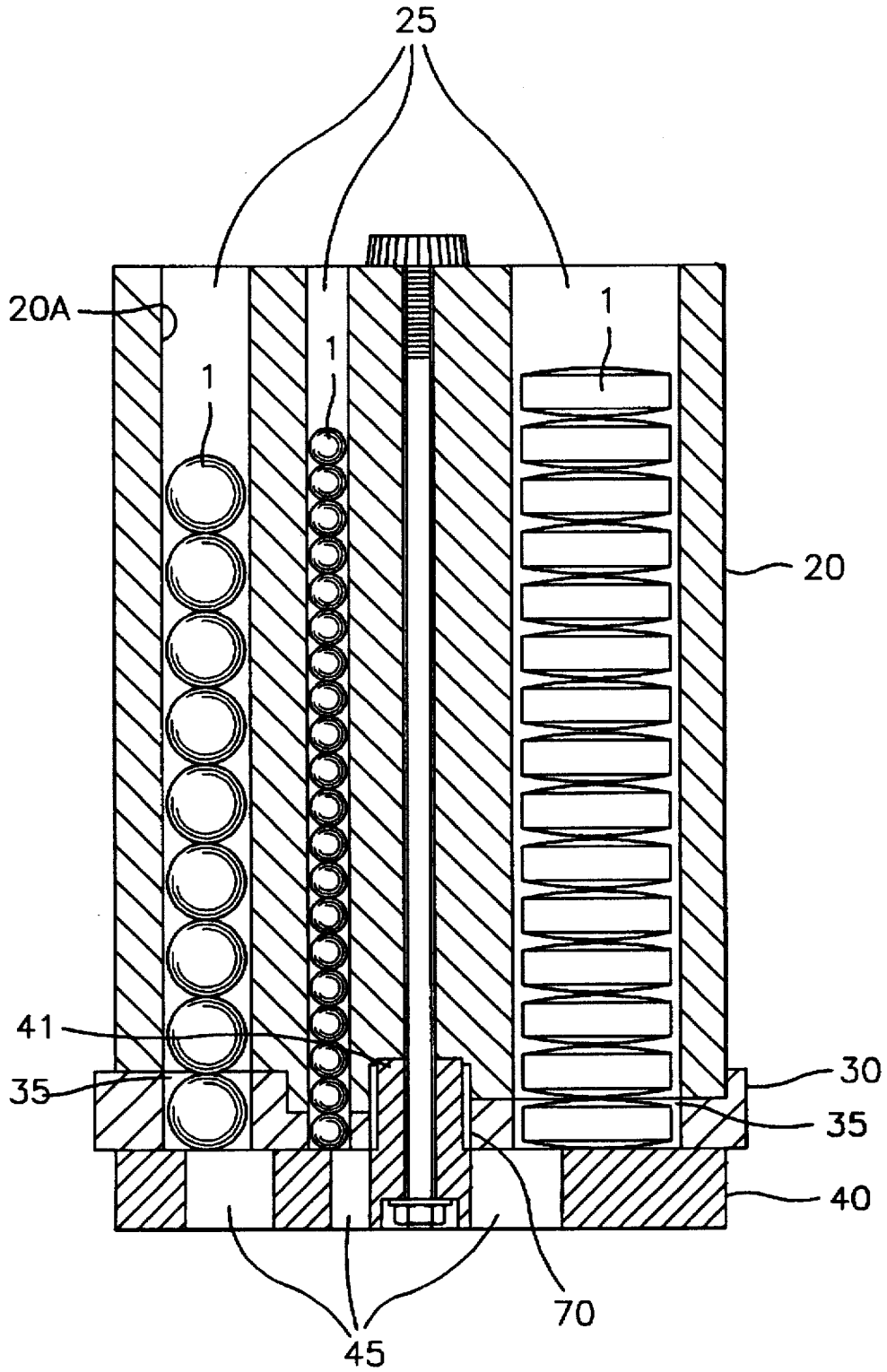
FIG. 6 is a cross-sectional view of the invention of FIG. 5 taken along line 6—6, particularly showing the placement of the pills within the conduits when the tray is in the normal, holding position.

In both embodiments, a bias means 70, such as a spring, is positioned so as to bias the middle housing portion to remain in the initial holding position 31 unless manually acted upon. After the tray has been moved into the release position 32, the bias means 70 automatically restores the middle housing portion to the holding position 31. In the embodiment shown in FIG. 5, the bias means 70 is preferably an elastic band, as best shown in FIG. 6. This coil spring is anchored in the upper housing portion 20 as seen in FIG. 9 and engaged with the middle housing portion 30 as shown in FIG. 8 so as to control the portion 30 to remain in the holding position 31 unless acted upon by the manual rotation of the middle housing portion 30.

When the pills are released through the lower conduits 45, they can either be deposited directly into the user's hand as preferred with the cylindrical embodiment, or, alternately, into a planar collection ramp 50 located below the lower housing portion 40. The collection ramp 50, as best shown in FIGS. 3 and 4, is oriented at a non-horizontal angle so that pills falling through the lower conduits 45 contact the collection ramp 50 and move, by momentum, forward to a collection position 41. Preferably, a door 60 is hingably mounted in the support structure 10 adjacent the collection position 41, so that the pills remain within the apparatus until the door 60 is opened.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A pill housing apparatus for dispensing a plurality of pills of differing shapes, comprising:

an upper, middle, and lower housing portions, and, extending vertically therethrough, a plurality of parallel, vertically disposed conduits in adjacent positions forming a preferred positional arrangement, each of the conduits providing an interior sidewall closely conforming to the shape of one of the pills so that the pills may be stacked one above the other therein, the conduits in the upper and middle housing portions accommodating a plurality and a singularity of the pills respectively therein, the upper and lower housing portions being mutually joined in fixed juxtaposition such that the conduits in the lower one of the portions are misaligned with the conduits in the upper one of the portions, the middle one of the housing portions being movably engaged with and sandwiched between the upper and the lower housing portions, the middle one of the portions being normally positioned so that the conduits in the upper and the middle portions are aligned, allowing one of the pills in each of the conduits in the upper one of the portions to move downwardly into the corresponding one of the conduits in the middle one of the portions, and further positionable so that the conduits in the middle one of the portions are aligned with the conduits of the lower one of the portions thereby allowing the pills in the middle one of the portions to drop through the corresponding conduits in the lower one of the portions for dispensing the pills the apparatus accommodates and dispenses the multiple pills with a single rotary motion without the need of springs or other external forces.

2. The apparatus of claim 1 further including a biasing means urging the middle one of the housing portions to the normally positioned position.

3. The apparatus of claim 1 wherein the housing portions are constructed from a moldable plastic having at least partial transparency, so that pills in the upper one of the housing portions are visible.

4. The apparatus of claim 1 wherein the conduits in the upper one of the housing portions are sized to hold at least ten of the pills.

5. The apparatus of claim 2 wherein the housing portions are round in shape forming a multi-conduited cylindrical structure, the middle one of the housing portions rotatably mounted between the upper and the lower portions and constrained to move over a selected angular range between the normally positioned position aligning the corresponding conduits in the upper and the middle housing portions, and a further position aligning the corresponding conduits in the middle and the lower housing portions for dispensing the pills in the middle housing portion.

6. The apparatus of claim 5 wherein the lower of the housing portions provides an upward extending stud engagable in a cavity within the upper housing portion, the stud and cavity being of a D shape preventing mutual rotational motion between the housing portions.

7. The apparatus of claim 6 wherein the middle housing portion includes a central hole slightly larger in diameter then the stud of the lower housing portion so that the middle housing portion easily rotates about, and is constrained by the stud.

8. The apparatus of claim 7 wherein the bias means is an elastic bond bondably engaged between the stud of the lower housing portion and the hole of the upper housing portion.

9. The apparatus of claim 8 wherein a rotation of approximately 16 degrees of the middle housing portion provides for alignment of the conduits of the middle and the lower housing portions.

10. The apparatus of claim 9 wherein the conduits of the lower housing portion are open ended such that pills passing therethrough are dispensed into a hand held below the lower housing portion.

11. The apparatus of claim 10 wherein the middle housing portion has at least two differing thicknesses, providing for engagement of at least two different sizes of the pills respectively, whereby each of the two different pills each completely fill the respective conduits of the middle housing portion thereby preventing more than one of each of the pills to be dispensed with each rotation of the middle housing portion.

* * * * *